United States Patent [19]

Suwa et al.

[11] 4,207,096

[45] Jun. 10, 1980

[54] METHOD OF PRODUCING GRAPHITE-CONTAINING COPPER ALLOYS

[75] Inventors: Masateru Suwa, Tokai; Katsuhiro Komuro, Hitachi, both of Japan

[73] Assignee: Hitachi, Limited, Japan

[21] Appl. No.: 931,538

[22] Filed: Aug. 7, 1978

Related U.S. Application Data

[63] Continuation-in-part of Ser. No. 764,429, Jan. 31, 1977, abandoned.

[30] Foreign Application Priority Data

Feb. 2, 1976 [JP] Japan ..... 51/9365

[51] Int. Cl.[2] ..... C22C 9/00

[52] U.S. Cl. ..... 75/153; 75/134 C; 164/97

[58] Field of Search ..... 75/135, 153, 134 P, 75/0.5 AB, 163, 156.5, 159, 164, 168; 148/11.5 C, 12.7 C; 164/113, 120, 55, 97; 29/527.5, 527.7, 156.4 WL

[56] References Cited

U.S. PATENT DOCUMENTS

| | | | |
|---|---|---|---|
| 1,022,465 | 4/1912 | Cole | 75/156.5 |
| 2,793,949 | 5/1957 | Imich | 75/135 |
| 3,370,944 | 2/1968 | Kawasaki | 75/156.5 |
| 3,574,609 | 4/1971 | Finlay et al. | 75/153 |
| 3,600,163 | 8/1971 | Badia et al. | 75/153 |
| 3,668,748 | 6/1972 | Divecha et al. | 164/120 |
| 3,791,438 | 2/1974 | Ikeda et al. | 164/55 |
| 3,903,951 | 9/1975 | Kaneko et al. | 164/120 |
| 3,993,478 | 11/1976 | Hay et al. | 148/32 |
| 4,000,981 | 1/1977 | Sugafuji | 75/156.5 |

FOREIGN PATENT DOCUMENTS

| | | | |
|---|---|---|---|
| 673190 | 10/1963 | Canada | 75/134 P |
| 495511 | 11/1938 | United Kingdom | 75/135 |
| 500657 | 2/1939 | United Kingdom | 75/135 |

OTHER PUBLICATIONS

Mortimer, Nicholas, "The Wetting of Carbon by Copper and Copper Alloys," Journal of Materials Science (1970), pp. 149–155.

*Primary Examiner*—L. Dewayne Rutledge
*Assistant Examiner*—Peter K. Skiff
*Attorney, Agent, or Firm*—Craig and Antonelli

[57] ABSTRACT

A method of producing a copper-graphite particles composite alloy having good mechanical properties and good wear resistant property, which comprises preparing a metal of copper base alloy containing 0.1 to 10% by weight of Ti, Cr, Zr and/or Mg, dispersing graphite particles in the melt under agitation to form a homogeneous dispersion of the graphite particles, charging the melt in which the graphite particles are dispersed homogeneously into a heat conductive metal mold, and then applying a pressure of 150 kg/cm$^2$ or above to the surface of the melt until the solidification of the melt is finished.

16 Claims, 4 Drawing Figures

METHOD OF PRODUCING GRAPHITE-CONTAINING COPPER ALLOYS

This application is a continuation-in-part of application Ser. No. 764,429, filed Jan. 31, 1977 and now abandoned.

BACKGROUND OF THE INVENTION (1) Field of the Invention

This invention relates to a novel method of producing graphite-containing copper alloys, and more particularly to a method of producing copper alloys in which graphite particles are uniformly dispersed.

(2) Description of the Invention

Generally, alloys containing a solid lubricant are used for the mechanical slide contact parts in internal combustion engines, lubricant containing alloys were deduced from the necessity of complementing the lubricating performance by the own lubricating action of the solid lubricant in case the lubricating oil film is broken. It is well known that graphite can be widely used as such solid lubricant, and there have been produced various kinds of alloys containing graphite.

However, there still remain some difficult problems to be solved. For instance, when graphite is added to an even relatively light material such as aluminum, graphite might float-up and can hardly be dispersed uniformly, and it is to be particularly noted that no graphite and copper alloy of any practical value is so far available. This is ascribable, for one thing, to the following reason: graphite and copper are scarcely soluble to each other and also they differ largely in specific gravity, so that even if the graphite particles are charged into and dispersed in a molten bath of copper or copper alloy, they would float-up to cause unbalanced dispersion when the melt it cast into a mold. Such propensity is intensified proportionally to the size of the ingot produced.

As a novel technique for dispersing graphite, without causing float-up thereof, into a metal which is scarcely soluble with graphite (solubility in graphite being less than 0.005%), that is, a metal which is metallurgically termed as having no compatibility with graphite, there has been proposed recenty a method in which the graphite particles clad with metal coating such as nickel or copper coating are suspended in a gaseous dispersant and blown into the molten bath of a metal having no compatibility with graphite. This method has provided satisfactory results in applications to the metals having no compatibility with graphite, such as aluminum, zinc, magnesium and the like, but it still could not produce a satisfactory result in application to copper. There has been thus no alternative but relying on the powder metallurgical techniques for combination of copper and graphite. However, employment of such power metallurgical techniques requires higher expenditure than needed in casting, and also the obtained sintered products would prove to be inferior in mechanical properties to the castings or cast-forgings. Thus, a strong request has been voiced in the industry for development of a novel casting technique allowing uniform dispersion of graphite in copper without causing float-up of graphite.

SUMMARY OF THE INVENTION (1) Object of the Invention

It is an object of the present invention to provide a method of producing a copper-graphite particles composite alloy having good mechanical and wear resistant properties.

(2) Statement of the Invention

The method of this invention for manufacturing a graphite-containing copper alloy comprises the steps of:

(1) preparing a melt of a copper base alloy containing at least 50% by weight of copper and at least one member selected from the group consisting of Ti, Cr, Zr and Mg in amounts of 0.1 to 10% by weight in case of Ti, Cr and Zr and in an amount of 6 to 10% by weight in case of Mg, (2) introducing into the melt graphite particles of which at least 95% particles have a particle size ranging between 50 and 2,000 μm in an amount of 5 to 50% by volume based on the total volume of the melt and the graphite under agitation to homogeneously disperse the particles in the melt, until the particles are wetted with the melt by the action of the member, (3) charging the melt into a heat conductive metal mold, keeping the homogeneous dispersion, and (4) applying to the surface of the melt until the solidification of the melt is substantially finished a pressure of at least 150 kg/cm$^2$ with a plunger so as to accelerate the heat transfer from the melt to the metal mold, and to supply the melt into micro holes which may be formed in a solidifying ingot.

The ingots made from the graphite-containing copper alloys obtained according to the method of this invention have the graphite particles dispersed substantially uniformly through the entire structure.

The casting method has several advantages over the powder metallurgical techniques, such as, for example, it allows formation of the parts with complicated configurations and also the manufacturing cost can be reduced, and for these reasons, casting is widely employed for manufacture of various kinds of machine parts. However, the situation is somewhat different in the case of the graphite-dispersed cast alloys. In such alloys, the graphite particles tend to segregate in the upper part of the ingot, and as graphite is added in the form of particles in the molten metal, the surface area of graphite becomes so large that the absorbed gas discharge from such surface area into the melt cannot be ignored. There are also involved the problems of gas produced during melting and solidication and shrinking propensity left potential in the alloy, and these elements combined together affect adversely the product quality and reliability, obstructing establishment of a mass production system for these alloys. It is therefore expected that successful attainment of stabilization of such internal qualities will promote production of machine parts by the casting method and will greatly contribute to the improvement of performance of the mechanical structures and reduction of manufacturing cost.

In order to comply with such request for quality improvement of the cast machine parts, the present inventors have strenuously pursued the fundamental studies on the method for allowing uniform dispersion of the graphite particles by applying a pressure of at least 150 kg/cm$^2$ with a plunger to the surface of the molten metal charged into the metal mold until completion of solidification and for realizing perfect elimination of the internal defects and obtainment of still finer structures, and as a result, it was revealed that such application of a hydrostatic pressure can provide a marked improvement of heat transfer from the solidifying melt to the metal mold, realizing inhibition of float-up of graphite and uniform distribution of graphite particles in the alloy as well as elimination of the internal defects. At the same time, the metallurgical structure of the ingots is made fine to improve mechanical properties of the composite alloys. It was also found that the pressure applied to the melt at the time of solidification thereof should preferably be from 300 to 700 kg/cm$^2$ for eliminating even micro porosity.

The application of the high pressure during the solidification of the melt causes the melt to be supplied to micro-holes which may be formed by inclusion of gases and by solidification shrinkage of the melt.

The pressure should be applied to the surface of the melt immediately after casting the melt into the metal mold. Preferably, the pressure is applied within 5 seconds, and more preferably within one second.

The substantial inhibition of float-up of the graphite particles by addition of at least one of titanium, chromium, magnesium and zirconium to the molten bath of copper alloy has been ascertained with reproducibility by many experiments. Any of the above-mentioned additive metals is of the type which produces a carbide in combination with graphite, so we considered that addition of a carbide-producing metal might have the effect of controlling floating migration of the graphite particles and tried to add such type of metals other than the above-mentioned four metals, but no significant effect was obtained. For instance, addition of manganese, silicon, nickel, iron, aluminum, cobalt and tin gave no appreciable effect. It was found that among many carbide-forming metals, only four metals mentioned above, that is, chromium, titanium, magnesium and zirconium, have the eminent effect of inhibiting float-up of graphite.

The amounts of these additive elements or metals added in copper are within the range from 0.1 to 10 weight % in the case of chromium, titanium and zirconium and 6 to 10 weight % in the case of magnesium, the weight % being based on the total weight of the melt of the copper alloy and the additive metal. Such range is also recommendable in total amount in case two or more of these metals are used in admixture. It should be noted that use of any of said metals in excess of the above-defined amount range results in production of a brittle alloy which has no practical value. Also, magnesium loading of less than 6 weight % proves to be insufficient to inhibit float-up of graphite.

The graphite particles loading in the alloys obtained according to the method of this invention should not be less than 5 volume % for adaptation as slide parts such as bearings, pistons, gears, etc., because of the self-lubricating action of the solid lubricant contained in the alloys. The graphite loading should be up to 50 volume % for providing satisfactory strength and other general mechanical properties in adaptation as mechanical parts.

In the method of this invention, the size of the graphite particles gives no prominent influence to uniform dispersion of graphite, and therefore no careful attention is required for selection of the graphite particles used, but actually it is practical to use the graphite particles with sizes of greater than 50 μm because use of such sizes of graphite particles can facilitate adaptation to the slide contact parts. When the particle size of the graphite particles is less than 50 μm, and when the amount of the carbide forming metal is large with respect to that of the graphite particles, the self-lubricating properties of the composite copper alloys will be lost, because in the above case all or a predominant amount of graphite particles may react with the additive to form carbide. If the particle size is larger than 50 μm, the separation of graphite from copper is reduced. The particle size of the graphite particles is within a range of from 50 to 2000 microns. Preferably, the particle size of the graphite particles is within a range of from 150 to 1,000 microns.

In uniformalizing the dispersion of the graphite particles, the molten metal temperature exerts an influence. The preferred range of such melt temperature is the one which is 20° to 100° C., preferably 30° to 60° C. higher than the liquidus line temperature. If the melt temperature is lower than the above-mentioned temperature, fluidity of the melt becomes insufficient to increase the risk of causing formation of cold shut or voids, resulting in impaired ingot quality. On the other hand, if the melt temperature becomes higher than the above-mentioned temperature, the graphite particles become liable to float-up.

The liquidus line temperatures of the melt are generally determined by reference to phase diagrams of respective copper alloys. If the compositions of the alloys are not found in the diagrams, time-temperature curves with respect to such alloys are measured by a thermal analysis method which is well-known in the art.

Introduction of a dispersant gas is quite meaningless as it brings about no such improvement as can be recognized by macrostructural photographs or other means. However, introduction of the graphite particle coating means such as nickel, copper or cobalt is recommendable as it intensifies the bonding reaction between the graphite particles and the elements such as titanium, chromium, magnesium and zirconium in the melt of copper alloy to increase the inhibitory effect against float-up of the graphite particles.

The metals used for coating of the graphite particles in this invention are subject to no specific restrictions other than that they have compatibility with copper. All of the metals used in the experiments of this invention, such as nickel, copper, cobalt, chromium and iron, had an activity to inhibit float-up of graphite. Any suitable coating method such as, for example, gas phase plating or liquid phase plating can be used, but it is most preferred to employ electroless plating containing the hypophosphorous acid groups to form a nickel coating. This method allows existence of phosphorus in abundance in the nickel deposit, and such phosphorus elutes out when nickel is melted in the molten metal to serve as a degasser, allowing production of the solid and high-quality ingots. It is considered that the coating metal plays the role of keeping the graphite particle surfaces clean. When a graphite-containing copper alloy produced by using the metal-coated graphite particles is observed structurally by an optical microscope, it is noticed that the coating metal is fused and the melt is solidified in a state where it is directly contacted with graphite. It is thus apparent that float-up of the graphite particles is attributed not simply to small specific gravity of graphite but rather to the improper surface condition. It is considered that the coating metal can well compensate for such deficiency. The thickness of the metal coating should preferably be in a range of 0.5 to 50 microns. If the thickness of the metal coating is less than 0.5 microns, improvement of distribution capability of the graphite particles is not sufficient. On the other hand, the thickness of the metal coating of more than 50 microns is uneconomical. Preferable range of the coating is within a range of 2 to 10 microns.

With these facts in mind, we attempted to charge the metal-coated graphite particles into the molten metal bath after treating the surfaces of the graphite particles or metal coating for reduction cleaning to keep them free of any oxide film and could obtain good results. It was also found that very excellent results can be obtained by performing such reduction cleaning treatment at a temperature of from 400° to 300° C.

The graphite-containing copper alloy obtained according to the method of this invention should contain at least 50% by weight of copper for providing satisfactory abrasion strength and thermal and electrical conductivities to the alloy in adaptation as mechanical parts. Additive elements are classified into two groups, one of which is so-called alloying elements contained in copper base matrix such as aluminum, zinc, tin, lead, iron, manganese, etc., and the other being additive elements for providing wettability between copper base matrix and graphite particles, i.e. titanium, chromium, zirconium and/or magnesium. Examples of copper base matrix are aluminum bronze containing 8 to 12% aluminum, brass containing 30–40% zinc, bronze containing 5–15% tin, a copper alloy known as BC-6 containing 5% tin, 5% zinc and 4% lead and a high strength brass containing 3% manganese, 1.5% iron, 1.5% aluminum and 35% zinc, the balance in each case being copper.

EXAMPLE 1

Figure 1:
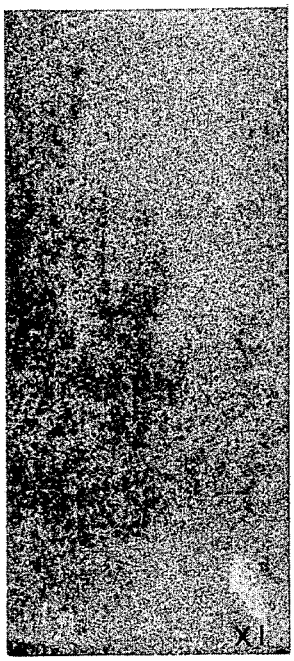
FIG. 1 is a macrophotograph showing a vertical section of an ingot made from a graphite-containing copper alloy produced according to one embodiment of this invention.

Natural graphite particles with particle size of 50 to 20 μm were chemically plated with copper to the thickness of 2 to 10 μm and then subjected to a cleaning treatment in a hydrogen atmosphere at 400° C. These copper-coated graphite particles were then charged into a melt of pure copper added with 6 weight % of magnesium, and then agitated. The melt temperature was maintained at a level 50° C. higher than the liquidus line temperature. The graphite particles were charged at the rates of 5, 10, 20 and 30% by volume, respectively. As a result, the whole amount of the graphite particles charged retained in the melt, and no float-up of the graphite particles charged retained in the melt, and no float-up of the particles was observed. Each of the thus prepared melts was then cast into a metal mold of low carbon steel to obtain ingots of 50 mm in diameter and 150 mm in length. Immediately after the charging, the melts were then solidified under a pressure of 630 kg/cm$^2$. Minute observation of each of the obtained ingots revealed uniform dispersion of graphite almost throughout the ingot structure.

EXAMPLE 2

Magnesium was added in amounts of 9 weight % and 10 weight %, respectively, to pure copper to prepare melts thereof, and then the copper-clad graphite particles same as used in Example 1 were charged into said melts and agitated while maintaining the melt temperature 50° C. higher than the liquidus line. The charges of the graphite particles were 5, 10, 20 and 30% by volume respectively. Each specimen of melts was cast into a metal mold of low-carbon steel to obtain ingots 0.7 second after the casting of the melt, a pressure of 200 kg/cm$^2$ was applied to the surface of the melt. Close observation along a vertical section of each of the obtained ingots disclosed that graphite was dispersed uniformly almost throughout the entire ingot structure.

EXAMPLE 3

Magnesium was added in amounts of 6 weight %, 9 weight % and 10 weight %, respectively, to pure copper to prepare melts thereof, and then nickel-coating graphite particles were charged into each of said melts while maintaining the melt temperature at a level 50° C. higher than the liquidus line. The graphite particles were charged at the rates of 5, 10, 20 and 30% by volume, respectively. Nickel coating was formed by chemical plating of nickel on the surfaces of 50 to 200 μm natural graphite particles and granulated natural graphite particles to the thickness of 2 to 10 μm. The thus coated graphite particles were then subjected to a cleaning treatment in a hydrogen atmosphere at 700° C. The melts charged with the nickel-coated graphite particles were well agitated and then cast to obtain 50 mm and 150 mml ingots 1 second after the casting a pressure of 400 kg/cm$^2$ was applied to the surface of the melt. A vertical sectional observation of each of the thus obtained ingots showed uniform dispersion of graphite almost throughout the entire ingot structure.

EXAMPLE 4

Chromium was added in amounts of 0.5 weight %, 1 weight % and 2 weight %, respectively, to the melts of pure copper, and then the copper-clad graphite particles as used in Example 1 were charged into said melts and agitated while maintaining the melt temperature at a level 50° C. higher than the liquidus line. The graphite particle charges were 5, 10, 20 and 30% by volume, respectively. These melts were solidified under a pressure of 630 kg/cm$^2$ which was applied within 0.7 second after the casting in a metal mold of iron to produce ingots of 50 mm in diameter and 115 mm in length. It was found that each of the thus obtained ingots had graphite particles uniformly dispersed throughout its structure from its bottom to its top surface.

EXAMPLE 5

The same operation as practiced in Example 4 was carried out by charging the nickel-coated graphite particles. The nickel coating was formed by chemical plating of nickel on the surfaces of natural graphite particles with a particle size of 50 to 200 μm to the thickness of 2 to 10 μm. It was noted from vertical sectional observation of each ingot that graphite was dispersed uniformly from the bottom portion of the ingot to its top surface.

EXAMPLE 6

Chromium was added in amounts of 0.5 weight %, 1 weight % and 2 weight % to aluminum bronze (with 9 weight % aluminum), bronze (with 8 weight % tin) and brass (with 40 weight % zinc), respectively, and the copper-coated graphite particles were charged into these melts and agitated while maintaining the melt temperature at a level 50° C. higher than the liquidus line. The graphite charges were 5, 10, 20 and 30% by volume, respectively. The melts were then solidified under a pressure of 630 kg/cm$^2$ which was applied within 0.5 second after the casting in a metal mold of carbon steel. Each of the obtained ingots had graphite dispersed uniformly therein and was quite satisfactory.

EXAMPLE 7

The same operation as Example 6 was performed by charging the nickel-coated graphite particles which were prepared according to the method shown in Example 3. A sectional observation of each ingot showed extremely uniform dispersion of graphite throughout the ingot structure.

EXAMPLE 8

Figure 2:
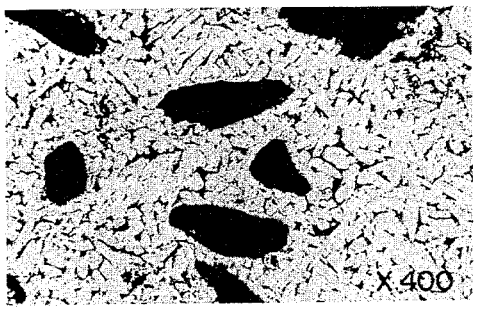
FIG. 2 is a microphotograph of an ingot made from a graphite-containing copper alloy produced according to another embodiment of this invention.

Titanium was added in amounts of 0.5, 1 and 2 weight % to each of pure copper, bronze (with 8 weight % tin), aluminum bronze (with 9 weight % aluminum) and brass (with 40 weight % zinc), and the nickel-coated graphite particles were charged into each of these melts while maintaining the melt temperature 50° C. higher than the liquidus line temperature. After agitation, each melt was solidified under a pressure of 630 kg/cm$^2$ the was applied within a 0.7 second after the casting in a metal mold of iron, obtaining ingots of 50 mm in diameter and 115 mm in length. The nickel-coated graphite particles were charged at the rates of 5, 10, 20 and 30% by volume. A close examination along a vertical section of each ingot revealed very excellent conditions of dispersion of graphite in the ingot structure. FIG. 1 shows the macrostructure along a vertical section of an ingot obtained by adding 1 weight % of titanium and 30 volume % of graphite to aluminum bronze, given here by way of an example. It is apparent that the graphite particles are very uniformly dispersed throughout the structure. FIG. 2 is a 400-time magnified microphotographic representation along a section of an ingot obtained by charging 0.5 weight % of titanium and 10 volume % of graphite into aluminum bronze. It is apparent that nickel coating has separated from the graphite surface and melted away. In the structure shown in FIG. 2, graphite is directly contacted with the aluminum bronze matrix, and perfectly no compound layer is seen on the graphite particle surfaces.

EXAMPLE 9

The same operation as practiced in Example 8 was followed by charging the copper-coated graphite particles which were prepared according to the method shown in Example 1. Graphite was uniformly dispersed in each obtained ingot.

EXAMPLE 10

Zirconium was added in amounts of 0.5, 1 and 2 weight % to each of pure copper, bronze, aluminum bronze and brass, to prepare melts thereof, and then the copper-coated graphite particles were charged into each of said melts while maintaining the melt temperature at a level 50° C. higher than the liquidus line temperature. The copper-coated graphite particles were charged at four different rates, that is, at the rates of 5, 10, 20 and 30 volume %. After agitation, each melt was solidified under a pressure of 630 kg/cm$^2$ applied within a 0.7 second after casting in a metal mold of iron. An examination along a vertical section of each of the thus obtained ingots showed uniform dispersion of graphite throughout the ingot structure.

EXAMPLE 11

The same operation performed in Example 10 was carried out by charging the nickel-coated graphite particles. A vertical sectional examination of each obtained ingot showed as uniform dispersion of graphite as obtained in Example 10.

COMPARATIVE EXAMPLE 1

Copper-coated graphite particles prepared by chemically plating 50 to 200 μm graphite particles with copper to the thickness of 2 to 10 μm were suspended in an argon gas and blown into the melts of pure copper, bronze, aluminum bronze and brass, respectively, while maintaining the melt temperature at a level 50° to 150° C. higher than the liquidus line temperature. Graphite particles were blown at the rate of 5 volume % in each case. As a result, graphite particles were not retained in the melt and floated-up to the surface layer of the melt.

COMPARATIVE EXAMPLE 2

The same process, as practiced in Comparative Example 1, was carried out by blowing graphite particles clad with 2 to 10 μm thick nickel coating. In this case, too, graphite particles floated-up to the melt surface.

COMPARATIVE EXAMPLE 3

The same operation as practiced in Comparative Examples 1 and 2 was carried out without using argon as dispersant gas. As a result, graphite particles floated up to the upper surface of the melt.

COMPARATIVE EXAMPLE 4

Each of the following elements: iron, silicon, nickel, manganese, cobalt, zinc, aluminum and iron, was added singly in amounts of 1, 2 and 5 weight % to each of pure copper, bronze, aluminum bronze and brass, and the copper-coated graphite particles were charged at the rate of 5 volume % into each of the prepared melts. In each case, graphite particles floated up to the melt surface.

COMPARATIVE EXAMPLE 5

The process of Comparative Example 4 was repeated by charging the nickel-coated graphite particles. The graphite particles floated up to the surface portion of the melt and were not dispersed uniformly in the melt.

COMPARATIVE EXAMPLE 6

An aluminum alloy containing 30 volume % of graphite was prepared by adding nickel-coated graphite particles, and the ingot made therefrom was cut and charged into the melts of pure copper, aluminum bronze and brass. However, graphite did not retain in the melt, and the substantial portion of graphite floated up to the melt surface section.

EXAMPLE 12

Figure 3:
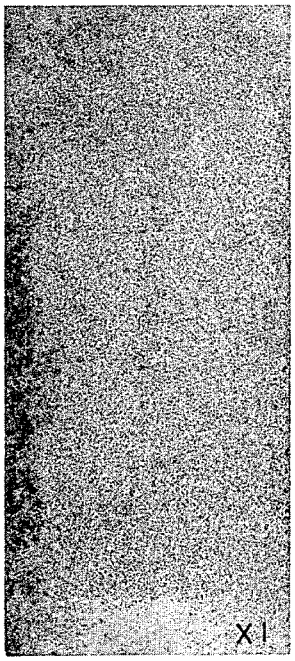
FIG. 3 is a macrophotograph showing a vertical section of an ingot made from a graphite-containing copper alloy produced according to still another embodiment of this invention.

FIG. 3 is a macrophotographic representation along a vertical section of an ingot produced by solidifying a copper alloy under pressure of 150 kg/cm$^2$. The alloy composition was copper, 9% aluminum and 0.7% titanium. The copper-plated graphite particles (with particle size of about 100 μm) were charged into the melt of said alloy at the rate of 20% by volume, and after agitation while maintaining the melt temperature 100° C.

higher than the liquidus line temperature, the melt was cast into a metal mold with inner diameter of 50 mm and pressed with a plunger 0.7 second after the casting. When no pressure is applied, graphite in copper alloys shows a stronger tendency to float-up than in aluminum alloys, but when pressure is applied, graphite is uniformly dispersed as apparent from FIG. 3.

EXAMPLE 13

Figure 4:
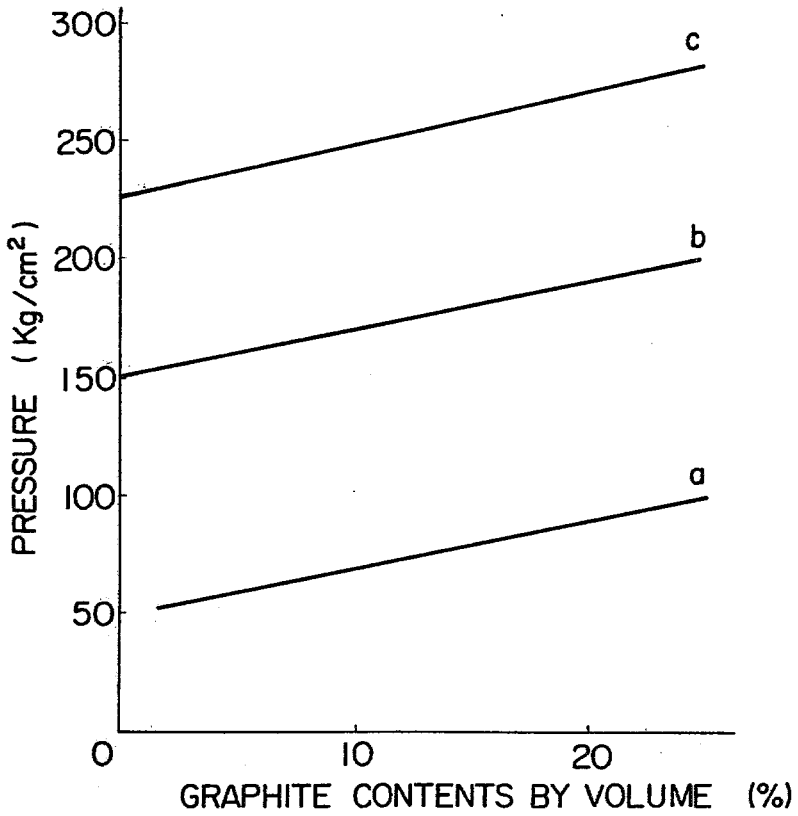
FIG. 4 is a diagram illustrating the relationship between graphite loading in alloys and pressure applied.

FIG. 4 is a diagram illustrating the relationship between pressure applied and graphite segregation in case the graphite particles having no metal coating were dispersed in a copper-8% tin-0.7% titanium alloy. The ingot obtained was of a columnar configuration with diameter of 100 mm and height of 150 mm. In the diagram, line a indicates the critical pressure for inhibiting float-up of graphite. It will be understood that in the pressure zone lower than the line a, a graphite-rich layer tends to be formed in the upper part of the ingot while there is a tendency, if not strong, to create a graphite-deficient layer in the lower part of the ingot, but if a pressure higher than the level indicated by line a is loaded, graphite particles are distributed substantially uniformly throughout the ingot structure.

Line b shows the critical pressure for elimination of the macrostructural defects in the ingot. This indicates that if the pressure applied is lower than the level of line b, although good graphite distribution may be obtained, there arises a tendency of producing the macrostructural defects such as shrinkage voids, but if the pressure applied is higher than the level of line b, almost no such defects appear. This dictates that it is desirable to apply a pressure which is higher than 150 kg/cm$^2$.

Line c shows the microporosity survival critical pressure as determined from the results of dye penetrant inspection and microscopic observations. It is noted that if pressing is performed at a pressure higher than this line, graphite is dispersed almost uniformly and also no micro- and macrostructural defects are induced.

A similar tendency is also observed in other types of copper alloys and in either case, a high-quality ingot can be obtained with application of a pressure of 300 kg/cm$^2$ or higher.

EXAMPLE 14

Natural graphite particles with particle size of 150 to 700 μm was used in this example. The graphite had no metal coating. The graphite particles were charged into a melt of a copper alloy consisting of 5% Sn, 5% Zn, 4% Pb, 0.5% P, 0.8% Ti and the balance being Cu. The melt temperature was maintained at a level 50° C. higher than the liquidus line temperature. The graphite particles were charged at the rate of 10% by volume. The melt was agitated until the graphite particles were well dispersed in the melt. As a result, the whole amount of the graphite particles charged retained in the melt, and no float-up of the particles was observed. The melt was then cast into a metal mold, maintaining the homogeneous dispersion. The cast melt was pressured by a pressure of 600 kg/cm$^2$, 0.5 second after the casting to obtain an ingot of 50mm in diameter and 150 mm in length. Minute observation of each of the obtained ingots revealed uniform dispersion of graphite particles throughout the ingot structure.

EXAMPLE 15

The same operation performed in Example 14 was carried out by charging the graphite particles having no metal coating into a melt of a copper alloy consisting of 5% Sn, 5% Zn, 4% Pb and the balance being Cu. The graphite particles with particle size of 165 to 195 μm was used. The amount of the graphite particles was 10% by volume based on the total volume of the melt and the graphite particles.

The vertical sectional examination of each obtained ingot showed a uniform dispersion of the graphite particles as obtained in Example 14.

Test pieces were machined out from the ingot. The test pieces having parallel portion of 8 mm diameter and 28 mm length were subjected to a tensile strength test at the room temperature. The test pieces having 8 mm diameter and 25 mm length were subjected to a wearing test. In the wearing test, the graphite copper alloy was used as a fixed test piece and a carbon steel having Vickers hardness of 205 was used as a movable test piece.

The tensile strength and elongation of the graphite containing copper alloy were 15 kg/mm$^2$ and 6%, respectively.

The wearing test was carried out under the conditions of a sliding speed of 0.2 m/s and a sliding distance of 2 km. in an oilless test. The contact pressure between the fixed test piece and the movable test piece was 25 kg/cm$^2$.

An amount of the wear of the graphite containing copper alloy was $5.7\times10^{-9}$ mm$^3$/mm.kg.

In a comparative example, the test pieces of the same chemical composition as that of the graphite containing copper alloy in Example 15 were pressured by sintering. The same tensile strength test and the wear test as those mentioned above were conducted. The tensile strength and elongation of the sintering test pieces were about 2 kg/mm$^2$ and zero %, respectively. An amount of the wear of the sintering alloy was about ten times that of the casting graphite containing copper alloy of the present invention.

What is claimed is:

1. A method for manufacturing a graphite-containing copper alloy which comprises the steps of:

(1) preparing a melt of a copper base alloy containing at least 50% by weight of copper and at least one member selected from the group consisting of Ti, Cr, Zr and Mg in amounts of 0.1 to 10% by weight in case of Ti, Cr and Zr and in an amount of 6 to 10% by weight in case of Mg, (2) introducing into the melt graphite particles of which at least 95% of the particles have a particle size ranging between 50 and 2,000 μm in an amount of 5 to 50% by volume based on the total volume of the melt and the graphite particles under agitation at a melt temperature 20° to 100° C. higher than the liquidus temperature of said copper base alloy, to homogenously disperse the particles in the melt, until the particles are wetted with the melt by the action of the at least one member, (3) charging the melt into a heat conductive metal mold, keeping the homogeneous dispersion of the particles, and (4) applying to the surface of the melt, immediately after said charging the melt, until the solidification of the melt is substantially finished, a pressure of at least 150 kg/cm$^2$ with a plunger so as to accelerate the heat transfer from the melt to the metal mold, and to supply the melt into macro holes which may be formed in a solidifying ingot in the metal mold, whereby flotation of graphite particles during solidification is substantially prevented.

2. A method for manufacturing a graphite-containing copper alloy according to claim 1, wherein said graphite particles have the surface free of a coating.

3. A method for manufacturing a graphite-containing copper alloy according to claim 1, wherein the graphite particles have a metal coating of a thickness of 0.5 to 50 microns.

4. A method for manufacturing a graphite-containing copper alloy according to claim 1, wherein the member is Ti.

5. A method for manufacturing a graphite-containing copper alloy according to claim 1, wherein the copper base alloy consists essentially of 5% by weight of Sn, 5% by weight of Zn, 4% by weight of Pb, 0.5% by weight of P, 0.8% by weight of Ti and the balance being copper.

6. A method for manufacturing a graphite-containing copper alloy according to claim 1, wherein the pressure applied to the surface of the melt is 300 kg/cm$^2$ or higher so that micro holes in the ingot are substantially eliminated.

7. A method for manufacturing a graphite-containing copper alloy according to claim 1, wherein an amount of graphite particles is 15 to 35% by volume based on the total volume of the melt and the graphite particles.

8. A method for manufacturing a graphite-containing copper alloy according to claim 1, wherein at least 95% of the particles have a particle size ranging between about 150 to 1,000 μm.

9. A method for manufacturing a graphite-containing copper alloy according to claim 1, wherein the pressure is applied within about 5 seconds after the charging the melt into the heat conductive metal mold.

10. A method for manufacturing a graphite containing copper alloy according to claim 9, wherein the pressure is applied within 1 second.

11. A method for manufacturing a graphite-containing copper alloy according to claim 1, wherein said melt temperature is 30° to 60° C. higher than the liquidus temperature of said copper base alloy.

12. A method for manufacturing a graphite-containing copper alloy according to claim 1, wherein said copper base alloy includes elements selected from the group consisting of aluminum, zinc, tin, lead, iron and manganese.

13. A method for manufacturing a graphite-containing copper alloy according to claim 1, wherein said copper base alloy consists of a copper base matrix and said at least one member, and wherein said copper base matrix is selected from the group consisting of aluminum bronze containing 8 to 12% aluminum and balance copper; brass containing 30–40% zinc and balance copper; bronze containing 5–15% tin and balance copper; copper alloy containing 5% tin, 5% zinc, 4% lead and balance copper; and brass containing 3% manganese, 1.5% iron, 1.5% aluminum, 35% zinc and balance copper.

14. A method for manufacturing a graphite-containing copper alloy according to claim 3, wherein said metal coating is made of a metal selected from the group consisting of nickel, copper, cobalt, chromium and iron.

15. A method for manufacturing a graphite-containing copper alloy according to claim 3, wherein said metal coating is a nickel coating formed by electrolessly plating nickel on the graphite particles from an electroless plating bath containing hypophosphorous acid groups.

16. A method for manufacturing a graphite-containing copper alloy which comprises the steps of:

(1) preparing a melt of a copper base alloy containing at least 50% by weight of copper and at least one member selected from the group consisting of Ti, Cr, Zr and Mg in amounts of 0.1 to 10% by weight in case of Ti, Cr and Zr and in an amount of 6 to 10% by weight in case of Mg, (2) introducing into the melt graphite particles, the surfaces of which particles are free from a metal coating, of which at least 95% of the particles have a particle size ranging between 50 and 2,000 μm in an amount of 5 to 50% by volume based on the total volume of the melt and the graphite particles under agitation at a melt temperature 20° to 100° C. higher than the liquidus temperature of said copper base alloy, to homogeneously disperse the particles in the melt, until the particles are wetted with the melt by the action of the at least one member, (3) charging the melt into a heat conductive metal mold, keeping the homogeneous dispersion of the particles, and (4) applying to the surface of the melt, immediately after said charging the melt, until the solidification of the melt is substantially finished, a pressure of at least 150 kg/cm$^2$ with a plunger so as to accelerate the heat transfer from the melt to the metal mold, and to supply the melt into micro holes which may be formed in a soldifying ingot in the metal mold.

* * * * *